US010777954B2

(12) United States Patent
Wu et al.

(10) Patent No.: US 10,777,954 B2
(45) Date of Patent: Sep. 15, 2020

(54) CABLE CONNECTOR ASSEMBLY

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/407,197

(22) Filed: May 9, 2019

(65) Prior Publication Data

US 2019/0267764 A1 Aug. 29, 2019

Related U.S. Application Data

(63) Continuation-in-part of application No. 16/034,771, filed on Jul. 13, 2018, now Pat. No. 10,333,263, and (Continued)

(30) Foreign Application Priority Data

Jun. 22, 2017 (CN) ..... 2017 1 0481305
Jul. 13, 2017 (CN) ..... 2017 1 0568686

(51) Int. Cl.

| | |
|---|---|
| ***H01R 24/64*** | (2011.01) |
| ***H01R 9/05*** | (2006.01) |
| ***H01R 13/502*** | (2006.01) |
| ***H01B 7/08*** | (2006.01) |
| ***H01R 13/6592*** | (2011.01) |

(Continued)

(52) U.S. Cl.

CPC ..... *H01R 24/64* (2013.01); *H01B 7/0823* (2013.01); *H01B 7/0861* (2013.01); *H01R 9/0515* (2013.01); *H01R 9/0518* (2013.01); *H01R 13/502* (2013.01); *H01R 13/5808* (2013.01); *H01R 13/6592* (2013.01); *H01R 24/60* (2013.01); *H01R 2107/00* (2013.01)

(58) Field of Classification Search

CPC ..... H01R 13/6592
See application file for complete search history.

(56) References Cited

U.S. PATENT DOCUMENTS 7,252,548 B2 8/2007 Huang
8,333,616 B2 * 12/2012 Su ..... H01R 13/6581 439/607.41

(Continued)

FOREIGN PATENT DOCUMENTS

CN 204884664 12/2015
CN 105702334 6/2016

(Continued)

*Primary Examiner* — Ross N Gushi
(74) *Attorney, Agent, or Firm* — Wei Te Chung; Ming Chieh Chang

(57) ABSTRACT

A cable connector assembly includes: a cable connector; a cable electrically connected with the cable connector; an outer shell enclosing at least a portion of the cable connector and enclosing a portion of the cable, the outer shell having an inner dimension greater than an outer dimension of the cable; and a filler filled between the outer shell and the cable.

20 Claims, 17 Drawing Sheets

Related U.S. Application Data a continuation-in-part of application No. 16/015,561, filed on Jun. 22, 2018, now Pat. No. 10,622,731.

(51) Int. Cl.

| | |
|---|---|
| ***H01R 13/58*** | (2006.01) |
| *H01R 107/00* | (2006.01) |
| *H01R 24/60* | (2011.01) |

(56) References Cited

U.S. PATENT DOCUMENTS

| | | | | |
|---|---|---|---|---|
| 8,403,706 | B2 * | 3/2013 | Wu | H01R 13/506 439/607.46 |
| 8,430,693 | B2 * | 4/2013 | Wu | H01R 13/6658 439/607.5 |
| 8,840,321 | B2 * | 9/2014 | Wu | G02B 6/3817 385/89 |
| 9,065,205 | B2 * | 6/2015 | Gao | H01R 13/5808 |
| 9,257,797 | B2 * | 2/2016 | Kuang | H01R 9/038 |
| 9,325,137 | B2 * | 4/2016 | Wu | H01R 13/405 |
| 9,350,126 | B2 * | 5/2016 | Little | H01R 24/60 |
| 9,356,400 | B2 * | 5/2016 | Little | H01R 4/023 |
| 9,397,435 | B2 * | 7/2016 | Xing | H01R 13/504 |
| 9,413,123 | B2 * | 8/2016 | Kao | H01R 13/2442 |
| 9,450,342 | B2 * | 9/2016 | Wu | H01R 13/6593 |
| 9,478,878 | B2 * | 10/2016 | Wu | H01R 9/0515 |
| 9,484,681 | B2 * | 11/2016 | Little | H01R 13/6597 |
| 9,502,841 | B2 * | 11/2016 | Little | H01R 4/023 |
| 9,520,673 | B2 * | 12/2016 | Xing | H01R 13/5845 |
| 9,590,363 | B2 * | 3/2017 | Wu | H01R 13/6585 |
| 9,620,910 | B2 | 4/2017 | Chen | |
| 9,680,260 | B2 * | 6/2017 | Fan | H01R 13/6585 |
| 9,698,540 | B2 * | 7/2017 | Xing | H01R 13/6593 |
| 9,698,544 | B2 * | 7/2017 | Wu | H01R 13/7175 |
| 9,705,241 | B2 * | 7/2017 | Wu | H01R 13/5845 |
| 9,751,144 | B2 * | 9/2017 | Wu | B23K 1/0016 |
| 9,780,490 | B2 * | 10/2017 | Xing | H01R 13/64 |
| 9,819,128 | B2 * | 11/2017 | Zhou | H01R 13/7175 |
| 9,843,143 | B2 * | 12/2017 | Wu | H01R 13/665 |
| 9,979,145 | B2 * | 5/2018 | Wu | H01R 24/60 |
| 10,348,010 | B2 * | 7/2019 | Wu | H01R 12/778 |
| 2013/0231003 | A1 * | 9/2013 | Wu | H01R 13/582 439/452 |
| 2015/0357751 | A1 * | 12/2015 | Gao | H01R 13/7175 439/460 |
| 2015/0364885 | A1 * | 12/2015 | Garvey | H01R 31/06 439/367 |
| 2016/0079689 | A1 | 3/2016 | Wu et al. | |
| 2016/0093987 | A1 * | 3/2016 | Wu | H01R 13/665 439/620.22 |
| 2017/0140851 | A1 | 5/2017 | Chen | |
| 2017/0187150 | A1 * | 6/2017 | Fabre | H01R 9/05 |
| 2018/0001407 | A1 | 1/2018 | Wu et al. | |
| 2018/0040969 | A1 | 2/2018 | Wu et al. | |
| 2018/0175540 | A1 * | 6/2018 | Wu | H01R 13/514 |

FOREIGN PATENT DOCUMENTS

| | | |
|---|---|---|
| CN | 205583296 | 9/2016 |
| CN | 106450827 | 2/2017 |
| CN | 107809016 | 3/2018 |

* cited by examiner

CABLE CONNECTOR ASSEMBLY

BACKGROUND OF THE INVENTION

1. Field of the Invention

The present disclosure relates to a miniaturized cable connector assembly.

2. Description of Related Arts

U.S. Patent Application Publication No. 2016/0079689, published on Mar. 17, 2016, discloses a cable connector assembly. The cable connector assembly includes a plug, a PCB connected with the plug, a cable connected with the PCB, a first metal shell receiving PCB and part of plug, a second metal shell receiving part of the first metal shell and cable, and a cage disposed outside the first metal shell and the second metal shell. The cable connector assembly has a large number of parts and a complex structure such that the overall size of the cable connector is large and it is difficult to meet demand for miniaturization.

An improved miniaturized cable connector assembly is desired.

SUMMARY OF THE INVENTION

Accordingly, an object of the present invention is to provide a cable connector assembly with simple and stable structure.

To achieve the above object, a cable connector assembly comprises: a cable connector; a cable electrically connected with the cable connector; an outer shell enclosing at least a portion of the cable connector and enclosing a portion of the cable, the outer shell having an inner dimension greater than an outer dimension of the cable; and a filler filled between the outer shell and the cable.

Other objects, advantages and novel features of the invention will become more apparent from the following detailed description when taken in conjunction with the accompanying drawings.

DETAILED DESCRIPTION OF THE PREFERRED EMBODIMENT

Reference will now be made in detail to the preferred embodiment of the present invention.

Figure 1:
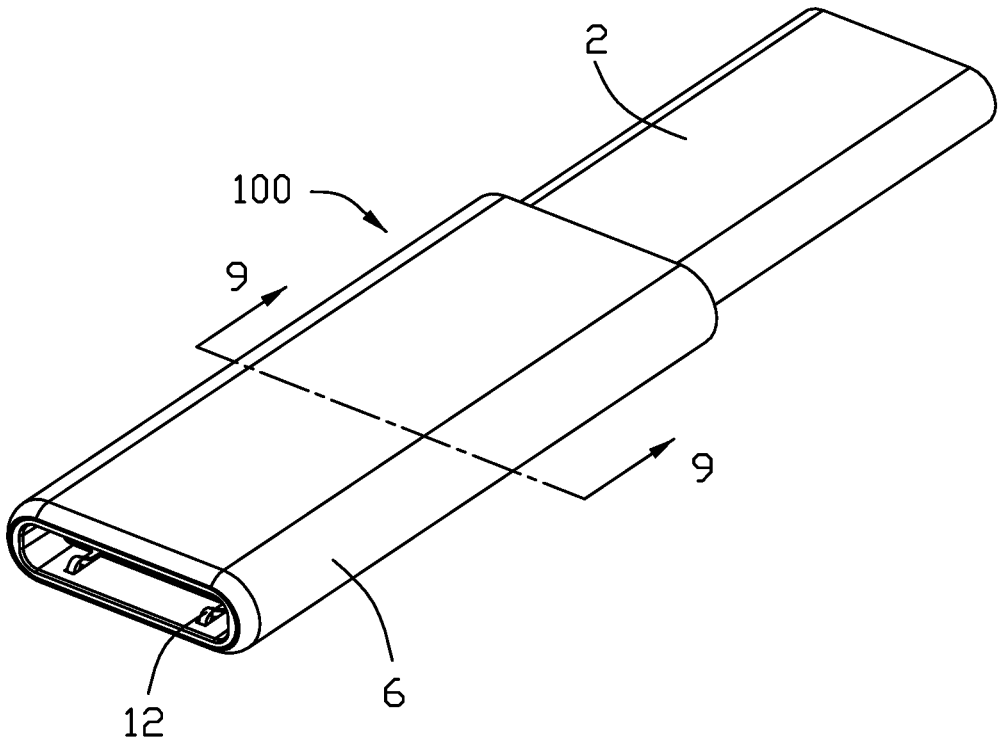
FIG. 1 is a perspective view of a cable connector assembly in accordance with a first embodiment of present invention.
Figure 2:
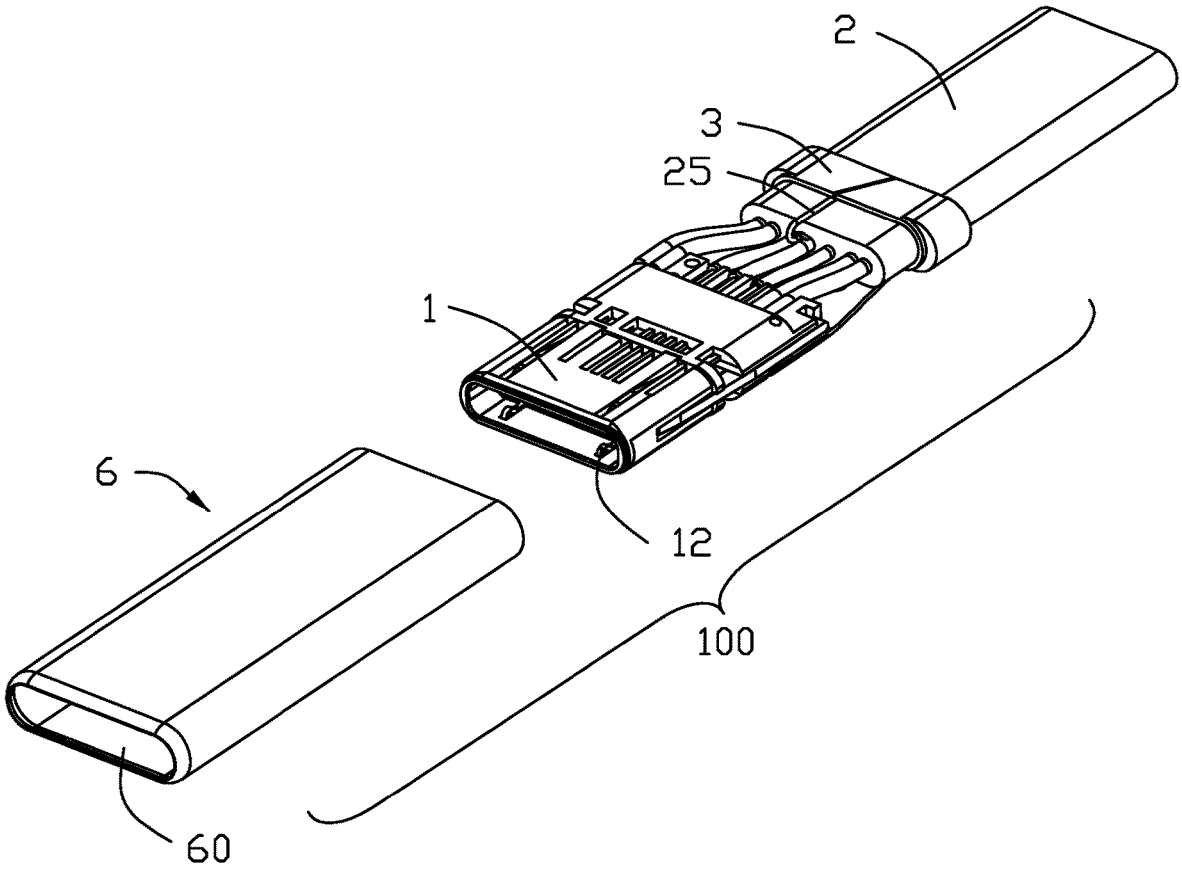
FIG. 2 is a partially exploded view of the cable connector assembly as shown in FIG. 1.
Figure 3:
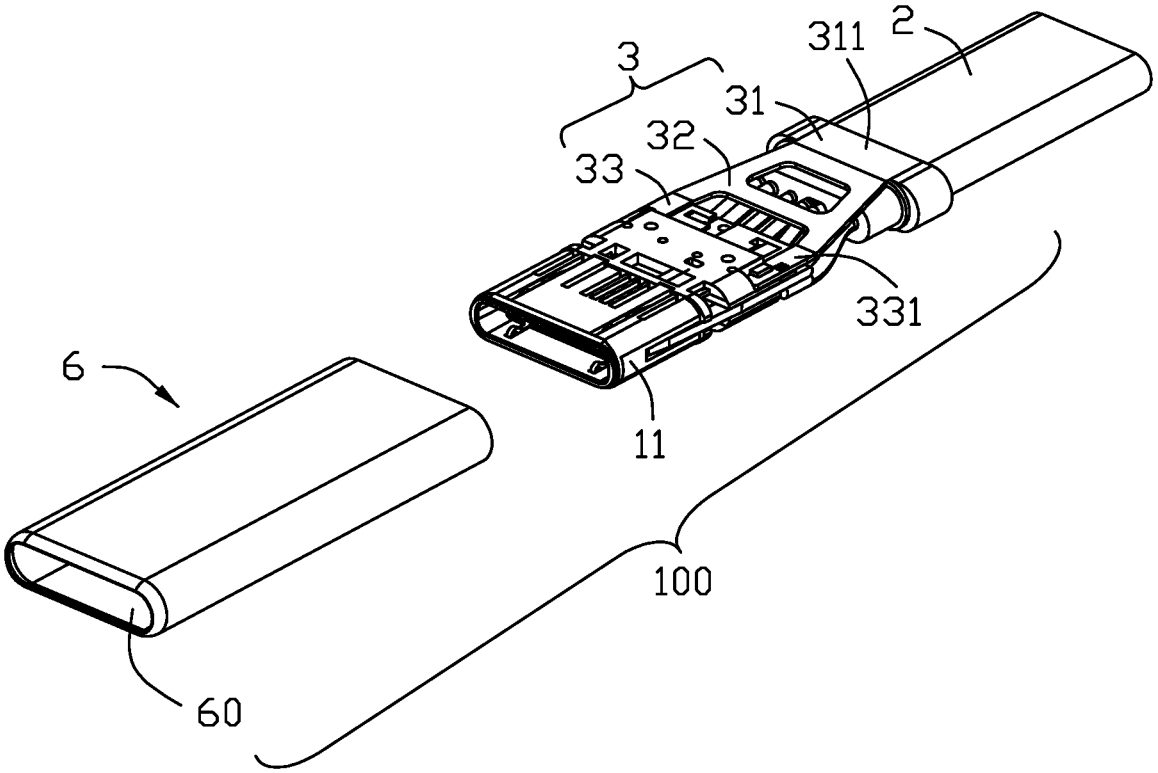
FIG. 3 is another exploded view of the cable connector assembly as shown in FIG. 2.
Figure 4:
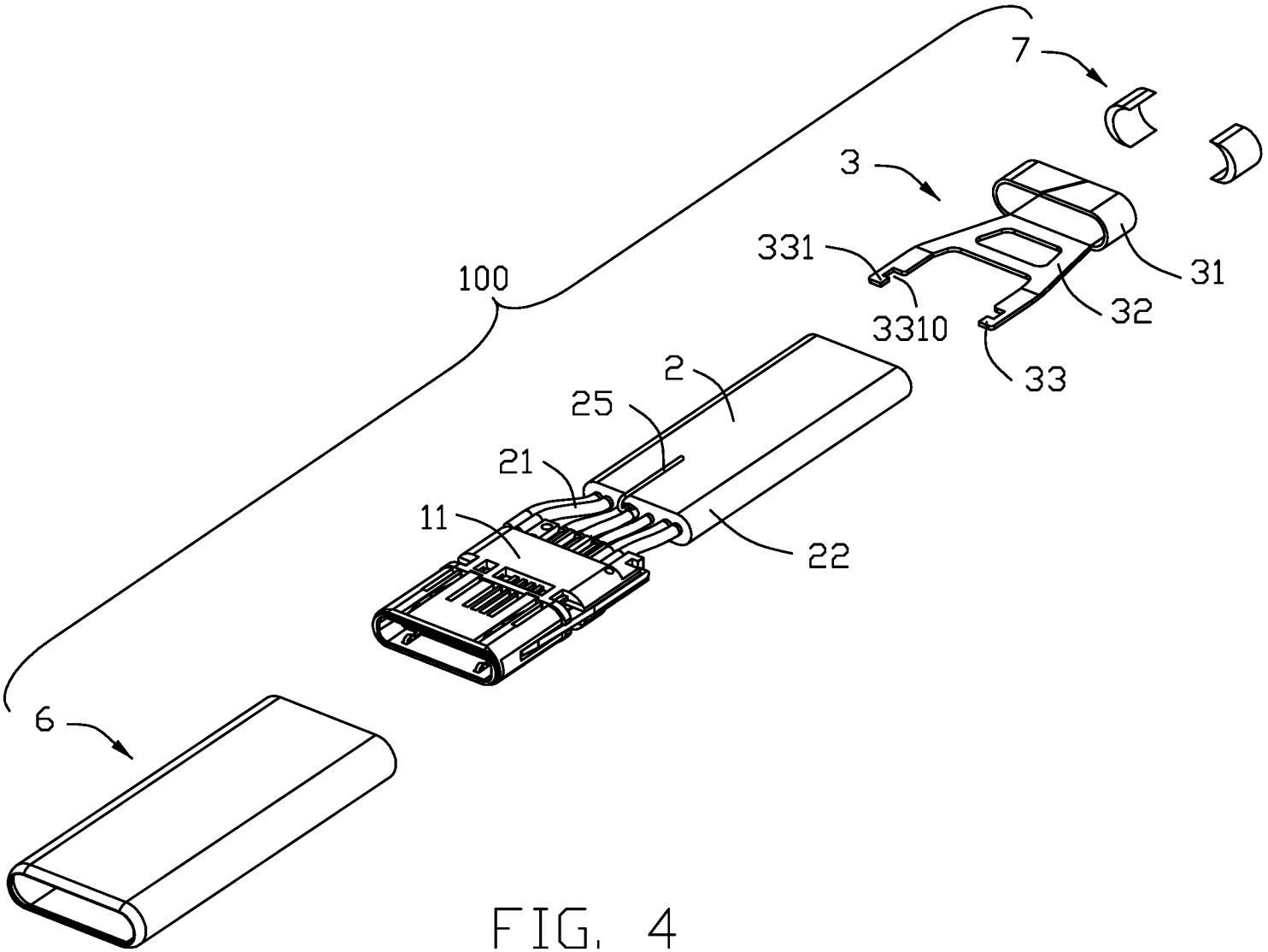
FIG. 4 is further exploded view of the cable connector assembly as shown in FIG. 2.
Figure 5:
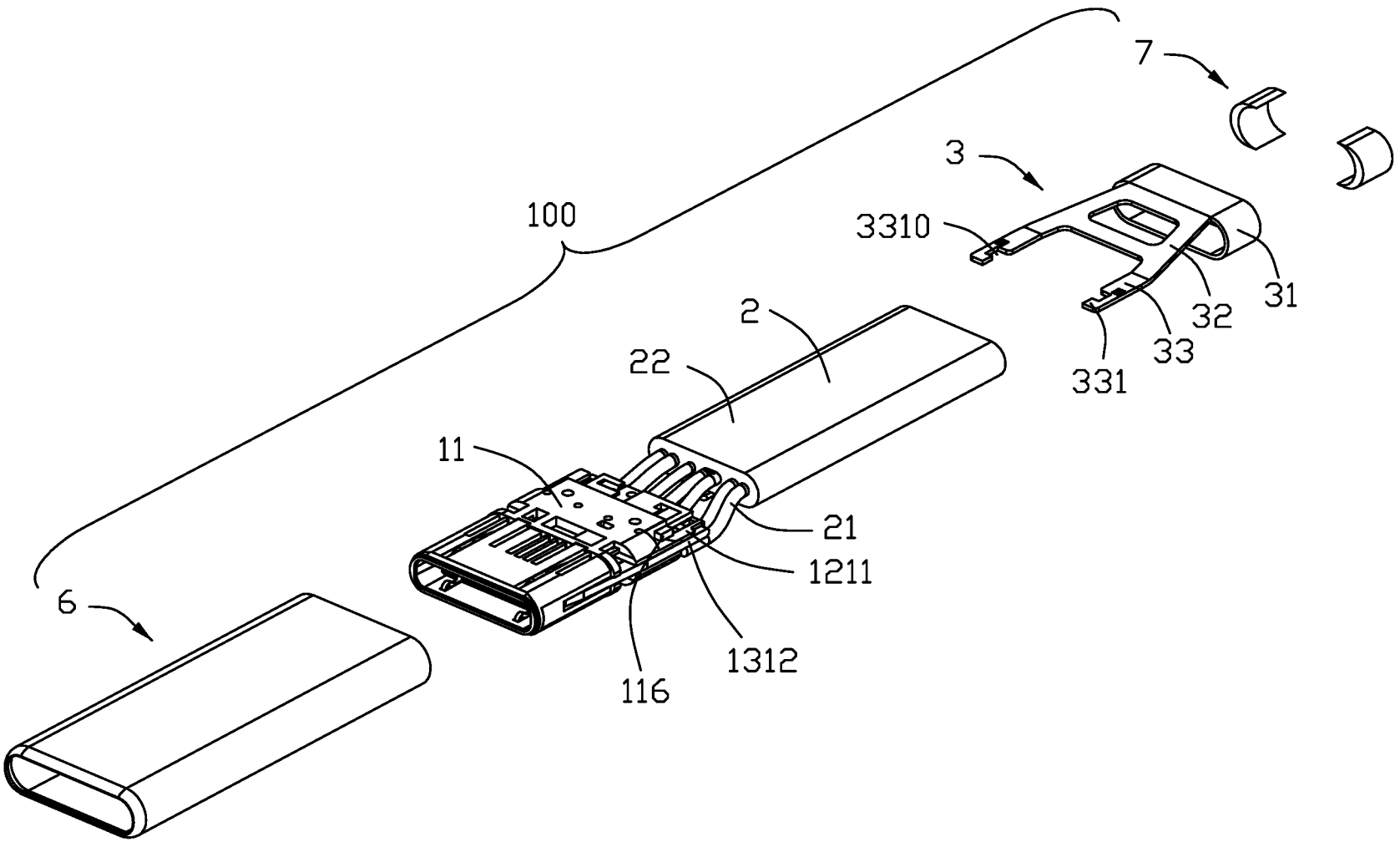
FIG. 5 is another exploded view of the cable connector assembly as shown in FIG. 4.
Figure 6:
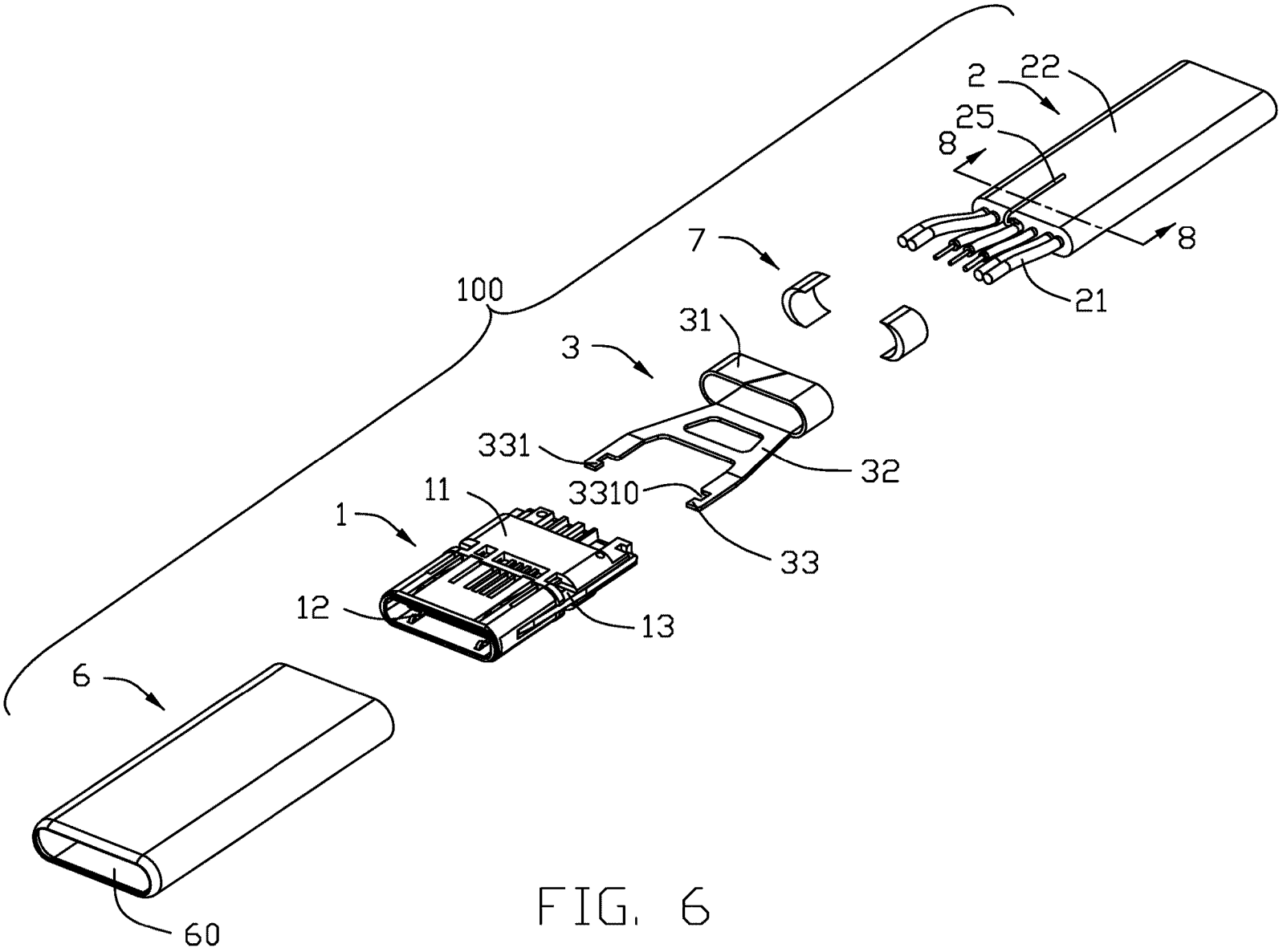
FIG. 6 is further exploded view of the cable connector assembly as shown in FIG. 4.
Figure 7:
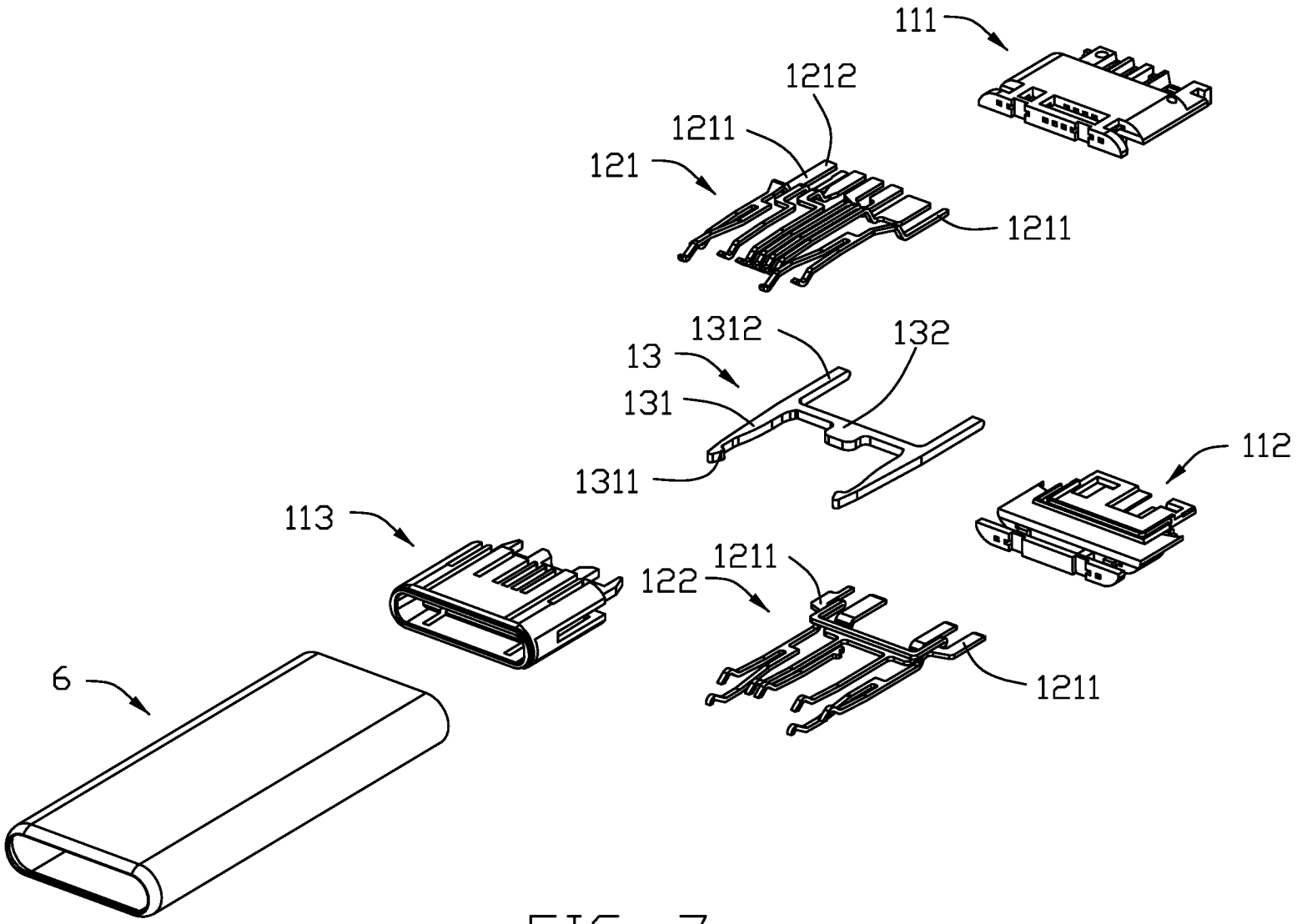
FIG. 7 is an exploded view of a plug and a metal shell of the cable connector assembly in the present invention.
Figure 8:
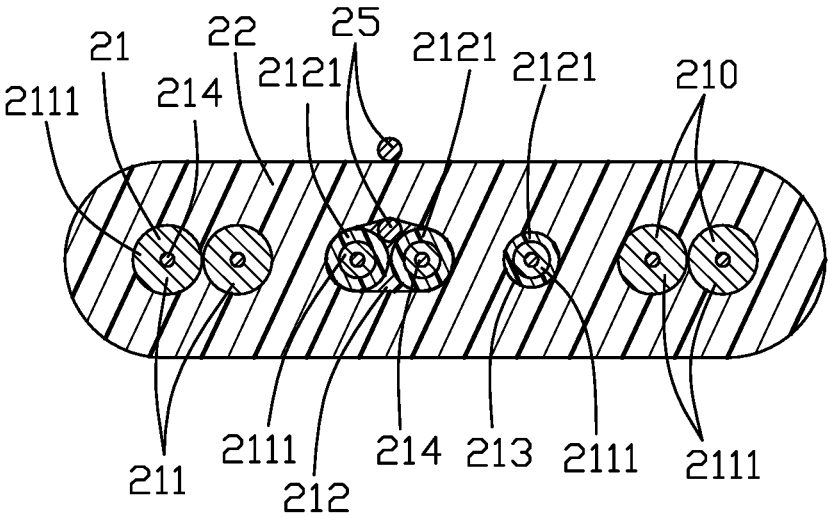
FIG. 8 is a cross-sectional view of a plug and a metal shell of the cable connector assembly taken along line 8-8 in FIG. 6.
Figure 9:
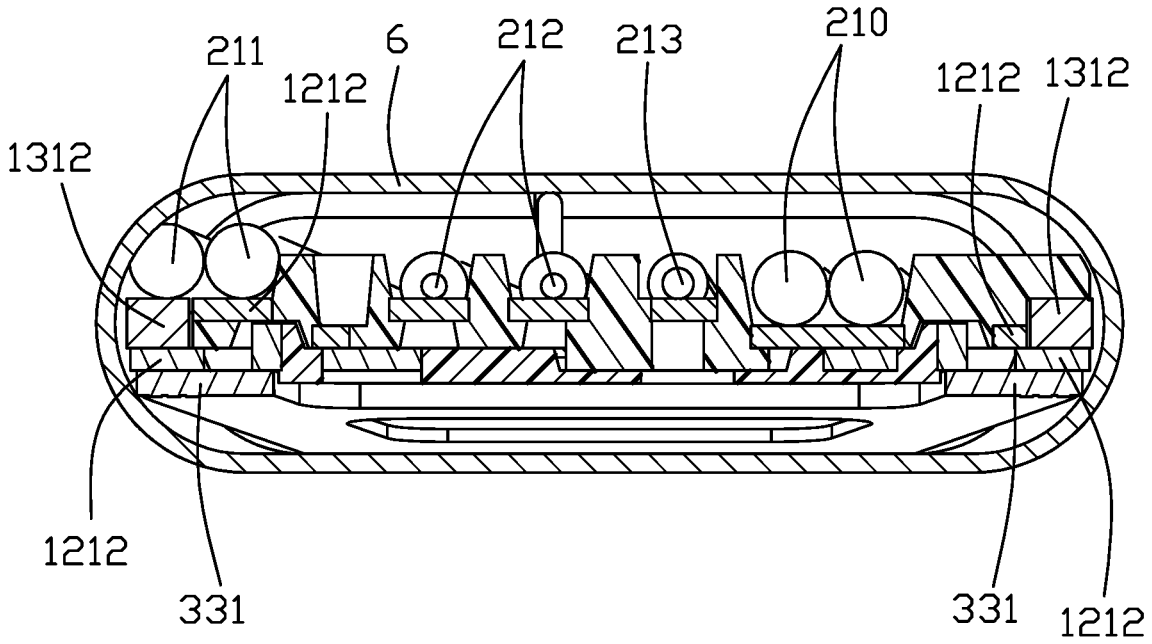
FIG. 9 is a cross-sectional view of the cable connector assembly taken along line 9-9 in FIG. 1.

Referring to FIGS. 1 to 9, a cable connector assembly 100, in accordance with a first embodiment of present invention, can be mated with the mating connector in two opposite directions and includes a plug 1, a cable 2 electrically connected with plug 1, a crimping member 3 crimped on the outside of the cable 2, and a metal shell 6 with receiving cavity 60 set on the outside of the plug 1 and cable 2. An inner mold (not shown) may be provided to enclose part of the plug 1 and the cable 2.

The plug 1 includes an insulative housing 11, a plurality of conductive terminals 12 received in the insulative housing 11, and a latch 13. The housing forms a mating member (not labeled) with a mating port (not labeled) in which the terminals 12 are exposed for mating. The conductive terminals 12 include a row of first terminals 121 and a row of second terminals 122. The latch 13 is sandwiched between the first terminals 121 and the second terminals 122. The insulative housing 11 includes a first housing 111 fixing the first terminals 121, a second housing 112 fixing the second terminals 122 and a front housing 113 assembled at the front of first housing 111 and second housing 112. The insulative housing 11 has a positioning block for fixing a reinforcement 33 of the crimping member 3. The conductive terminals 12 include a plurality of ground terminals 1211. In this embodiment, both sides of the first terminals 121 and the second terminals 122 are ground terminals 1211. In other embodiments, The ground terminals 1211 may also be disposed at other positions in the conductive terminals 12. The rear end of the ground terminals 1211 has a welding portion 1212. The latch 13 includes two spaced latch arms 131 and a connecting arm 132 connecting two spaced latch arms 131. The front end of two spaced latch arms 131 both have latching portion 1311 locked with a mating connector. The rear ends of two spaced latch arms 131 both have fixing portion 1312.

The crimping member 3 includes a crimping ring 31 crimped on the outside of the cable 2, a reinforcement 33 fixed to the tail of the plug 1 and a connecting portion 32 connecting the crimping ring 31 and the reinforcement 33. In this embodiment, the crimping ring 31 covers the outside of the cable 2. The connecting portion 32 extends forward from one wall of the four walls of the crimping ring 31. The reinforcement 33 is formed to extend forward from left and right sides of the connecting portion 32, and includes two fixing pads 331 extending forward from left and right sides of the connecting portion 32, respectively. The fixing pads 331 have a positioning hole 3310. The positioning hole 3310 cooperates with the positioning block 116 to limit the position. In other embodiments, the specific structure of the crimping member 3 can be determined according to actual conditions.

In this embodiment, cable 2 is a flat cable and includes a plurality of cores 21 and an outer layer 22 coated on the outer side of the cores 21. The core 21 may be a first core or a second core. Each core includes a conductor 2111. Conductor of the first core is a bare conductor. Each second core includes an insulative layer 2121 coated on the conductor 2111. In this embodiment, the cores 21 include a pair of adjacently disposed power wires 210, a pair of adjacently disposed grounding wires 211, and a signal wire 212 and a detection wire 213 disposed between the power wires 210 and the grounding wires 211. Two power wires 210 are adjacent to each other and transmit the same power signal. Two grounding wires 211 are also adjacent to each other and commonly transmit the same ground signal. The signal wires 212 have a grounding wire 25, and the grounding wire 25 is folded over and attached to the outer side of the cable 2. The pair of grounding wires 211 and the pair of power wires 210 are first cores, and the signal wires 212 and detection wire 213 are second cores. In this embodiment, each conductor 2111 may include a wire 214 to improve the bending performance of the cable 2. In the present embodiment, by setting the first cores to be bare conductors, the thickness of the cable is minimized while ensuring the thickness of the outer layer. In this embodiment, all the conductors 2111 employ an ultra-fine, copper alloy structure to reinforce the bending performance of the cable 2 itself. In other embodiments, the cable 2 may also be a round wire, and the internal structure of the cable 2 may also be set according to actual conditions.

During assembly, the conductive terminals 12 are accommodated in the insulative housing 11, and the latch 13 is sandwiched between the first terminals 121 and the second terminals 122. In this embodiment, the two fixing portions 1312 of the latch 13 are respectively welded to the corresponding one or two welding portions 1212 of the grounding terminal 1211 to achieve grounding. The grounding wire 25 of the cable 2 is folded and overlaid on the outside of the cable 2, the cable 2 is electrically connected to the rear end of the conductive terminals 12, and the crimping ring 31 is riveted on the outside of the cable 2. The grounding wire 25 is press-fitted therein to achieve electrical contact between the crimping ring 31 and grounding wire 25. The positioning hole 3310 of the fixing pads 331 of the reinforcement 33 is limited to the positioning block 116 of the insulative housing 1, and then the fixing pads 331 is welded and fixed to the welding portion 1212 of the grounding terminals 1211. In other embodiments, the reinforcement 33 may be directly welded and fixed with the fixing portion 1312 of the locking member 13, or fixed and electrically connected through other fixing methods. In another embodiment, the fixing piece 331 of the reinforcement 33, the welding portion 1212 of the grounding terminals 1211, and the fixing portion 1312 of the locking member 13 can be directly laser welded or other methods, and the three are simultaneously fixed and electrically connected together. Then, the inner mold is over-molded and mated with the cable 2 and the mating connector 1. Finally, the metal shell 6 is assembled from the rear thereof on the outside of the front end of the plug 1 and the cable 2. The front section of the metal shell 6 is glued to the inner mold by glue. The rear end of the metal shell 6 is pressed against the upper and lower walls 311 of the crimping ring 31 so that the crimping member 3 is grounded, so that the noise in the signal wire 212 is introduced into the ground through the metal shell 6. In a specific implementation process, a crescent-like plastic member 7 may be added between the metal shell 6 and the crimping ring 31 so that the metal shell 6 is in close contact with the crimping ring 31 to avoid gaps between the two metal parts, resulting in easy loosening of the structure. In the present invention, by adding the reinforcement 33 fixed to the plug 1 in the crimping member 3. On the one hand, the overall structure of the cable connector assembly 100 of the present invention is made stronger, and avoids the phenomenon of breakage in the place where cable 2 and plug 1 are connected, and strengthens the tensile strength of the entire cable connector assembly 100; on the other hand, because the reinforcement member 33 is in direct or indirect contact with the ground terminals 1211 to achieve electrical connection therebetween, the reinforcement member 33 is grounded through the ground terminal 1211 so that even if the crimping ring 31 and the metal shell 6 resist poorly, when the crimping member 31 cannot be grounded through the crimping ring 31, the crimping member 31 can still be grounded through the reinforcement 33 to reduce signal interference.

In a specific implementation process, a plastic member 7 may be added between the metal shell 6 and the crimping ring 31 so that the metal shell 6 is in close contact with the crimping ring 31 to avoid gaps between the two metal parts, resulting in easy loosening of the structure. In the present invention, by adding the reinforcement 33 fixed to the plug 1 in the crimping member 3. On the one hand, the overall structure of the cable connector assembly 100 of the present invention is made stronger, and avoids the phenomenon of breakage in the place where cable 2 and plug 1 are connected, and strengthens the tensile strength of the entire cable connector assembly 100; on the other hand, because the reinforcement member 33 is in direct or indirect contact with the ground terminals 1211 to achieve electrical connection therebetween, the reinforcement member 33 is grounded through the ground terminal 1211 so that even if the crimping ring 31 and the metal shell 6 resist poorly, when the crimping member 31 cannot be grounded through the crimping ring 31, the crimping member 31 can still be grounded through the reinforcement 33 to reduce signal interference.

Figure 10:
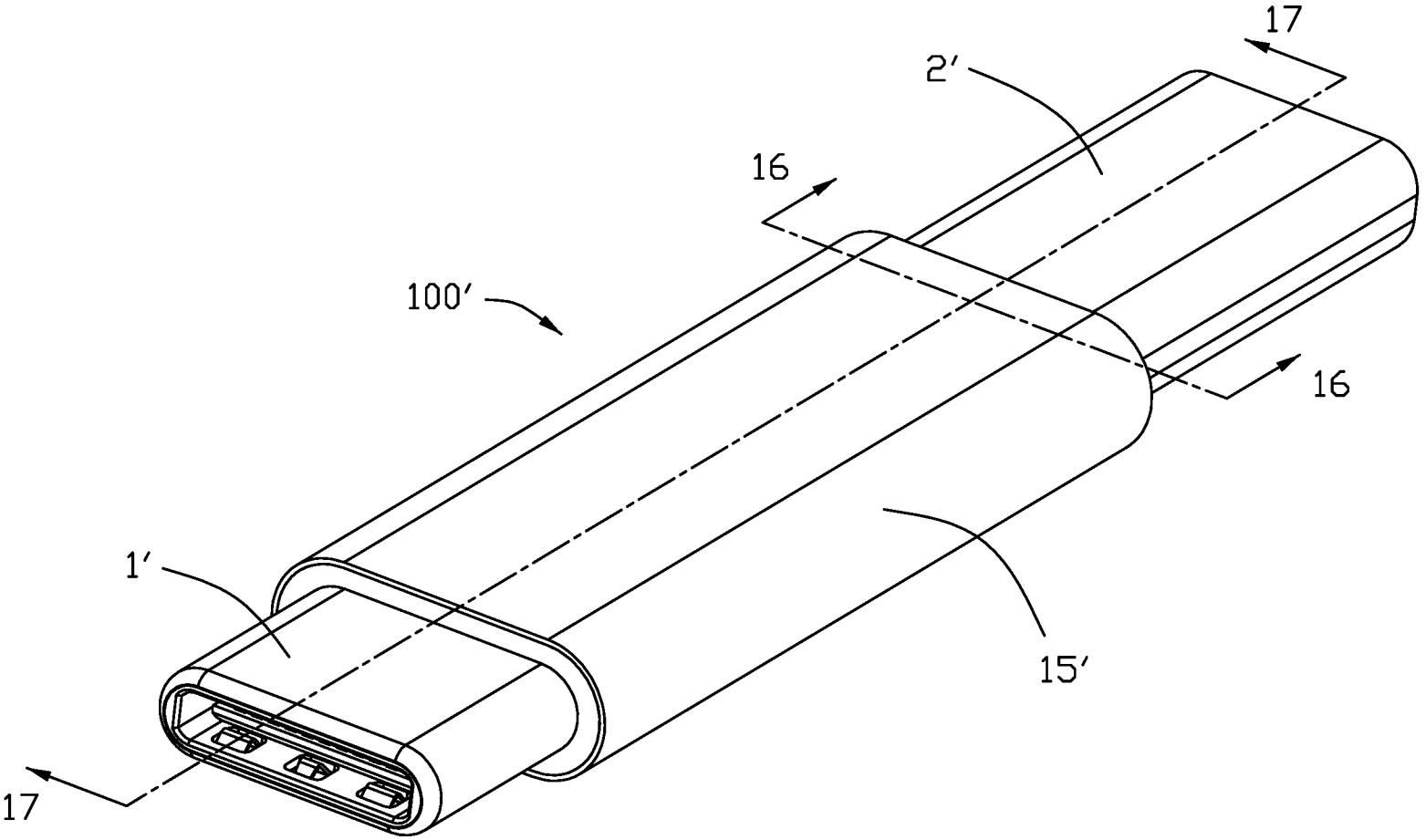
FIG. 10 is a perspective view of a cable connector assembly in accordance with a second embodiment of present invention.
Figure 11:
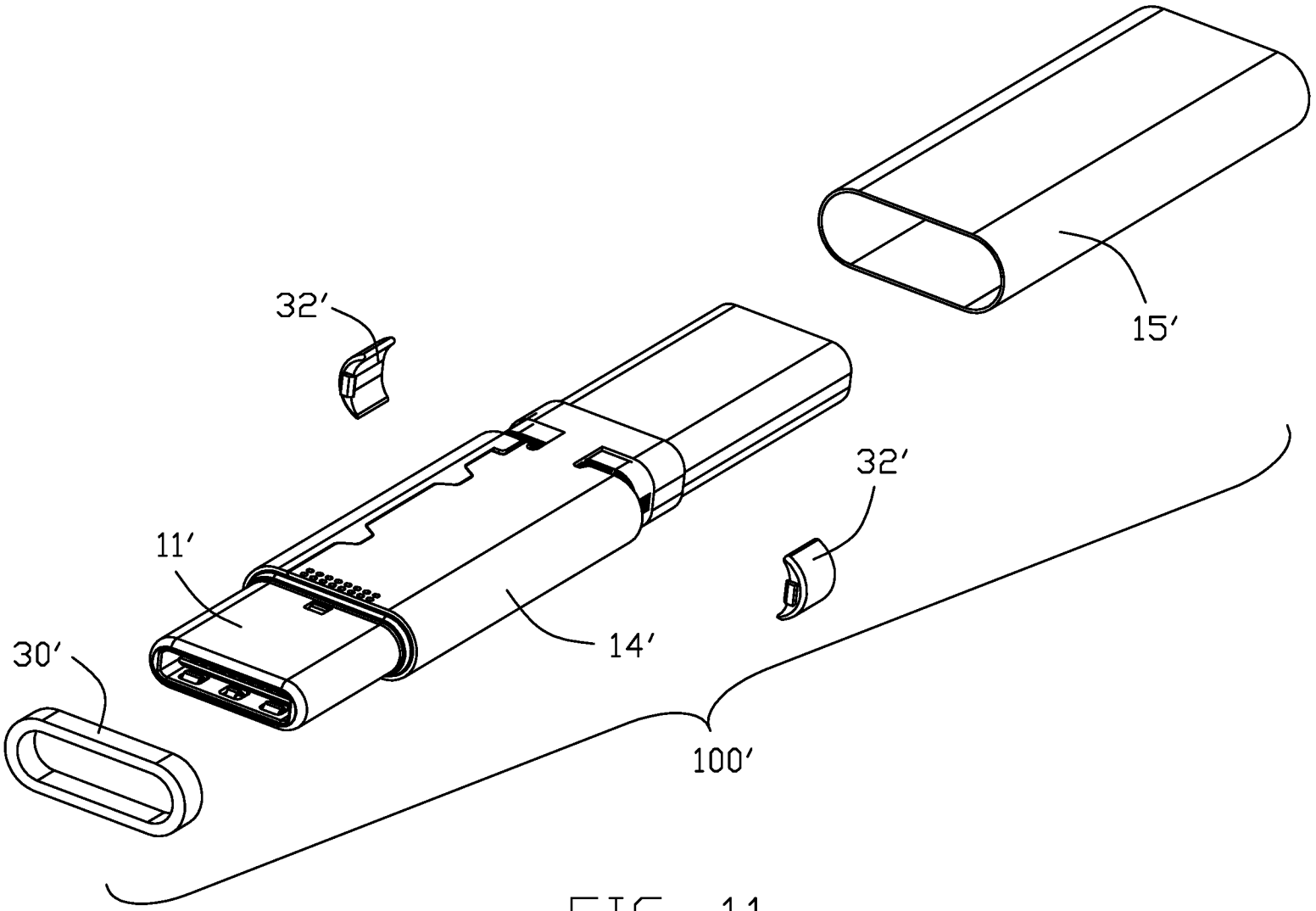
FIG. 11 is a partially exploded view of the cable connector assembly shown in FIG. 10.
Figure 12:
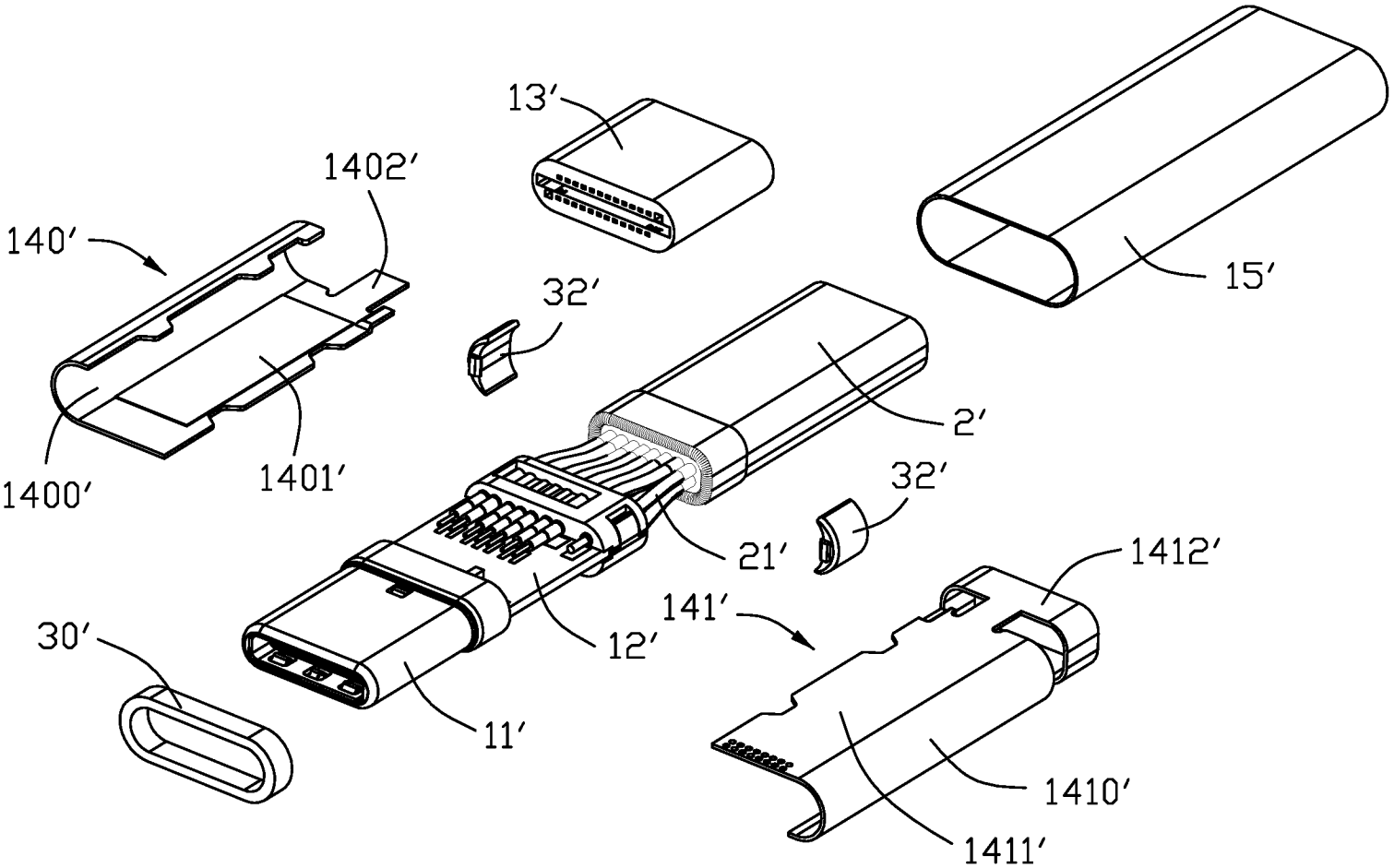
FIG. 12 is a further partially exploded view of the cable connector assembly shown in FIG. 11.
Figure 13:
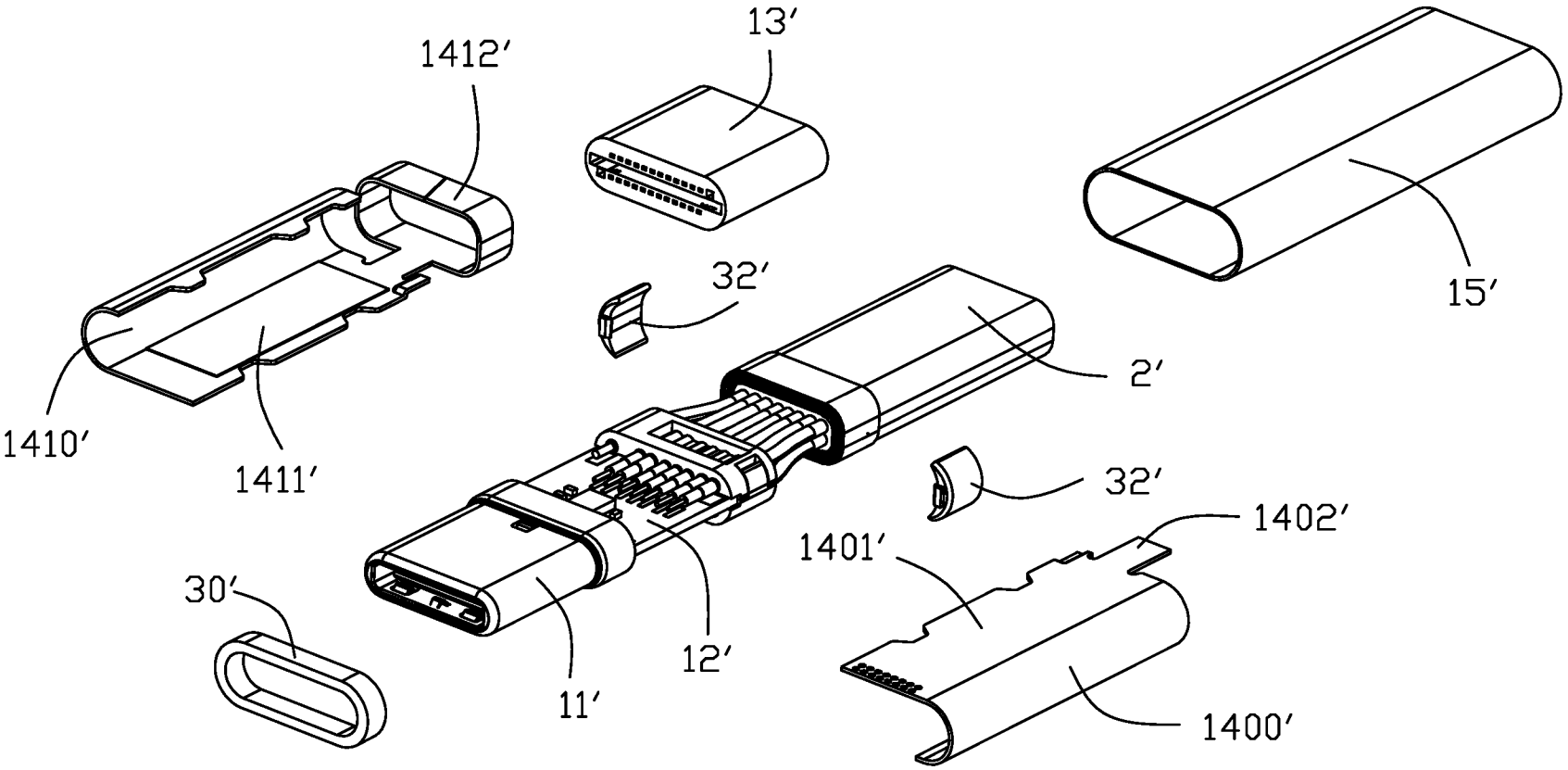
FIG. 13 is an exploded view similar to FIG. 12, but from a different perspective.
Figure 14:
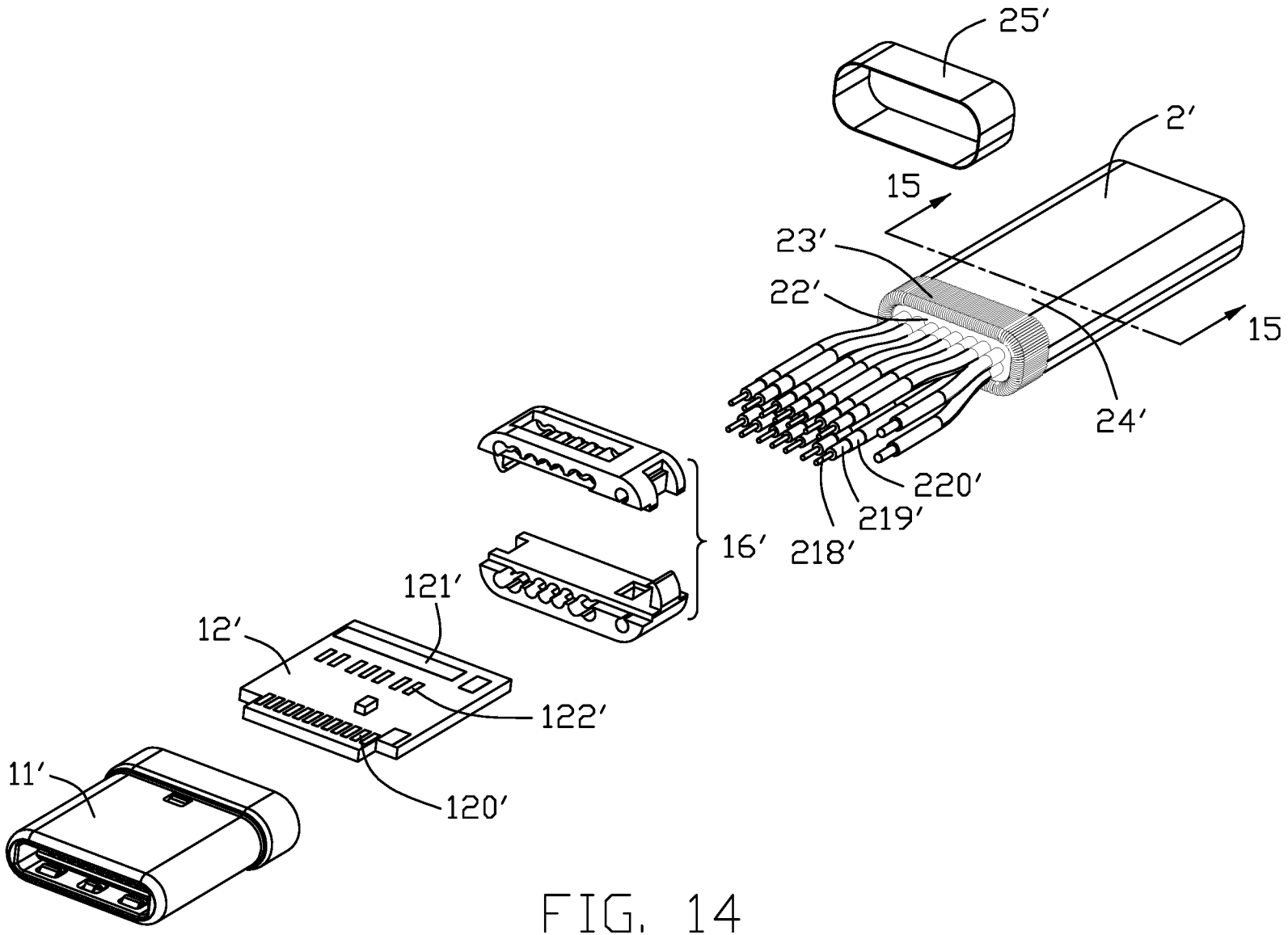
FIG. 14 is an exploded view of the cable connector assembly shown in FIG. 12.
Figure 15:
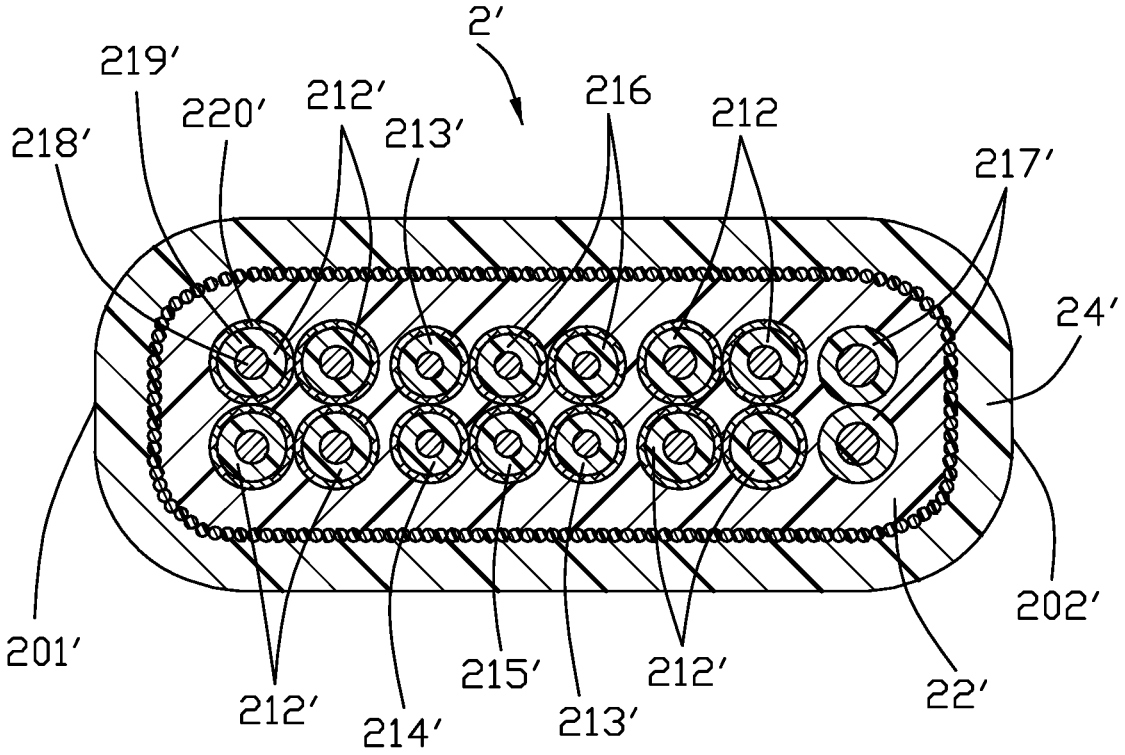
FIG. 15 is a cross-section view of the cable of the cable connector assembly taken along line 15-15 in FIG. 14.
Figure 16:
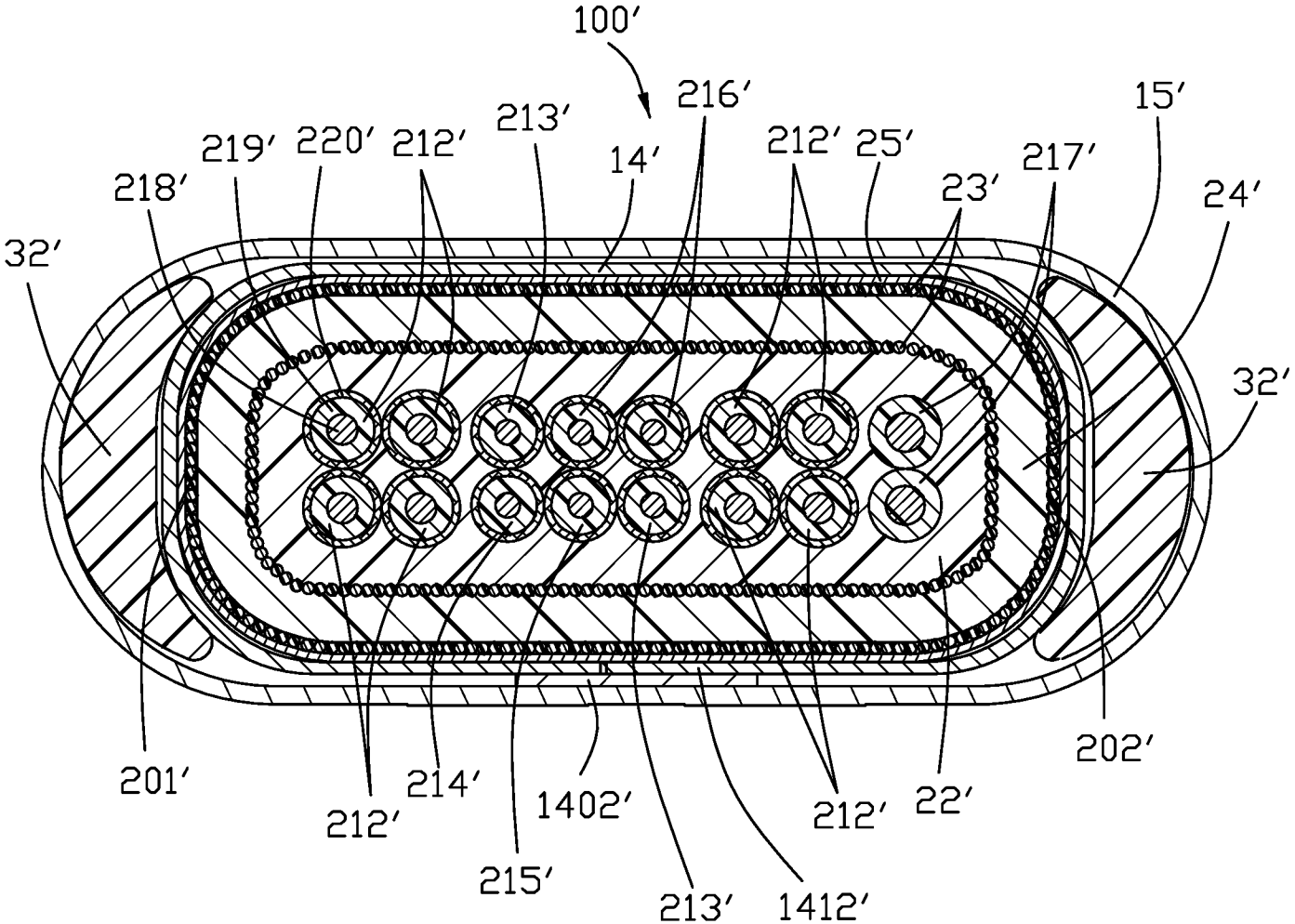
FIG. 16 is another cross-section view of the cable of the cable connector assembly taken along line 16-16 in FIG. 10.
Figure 17:
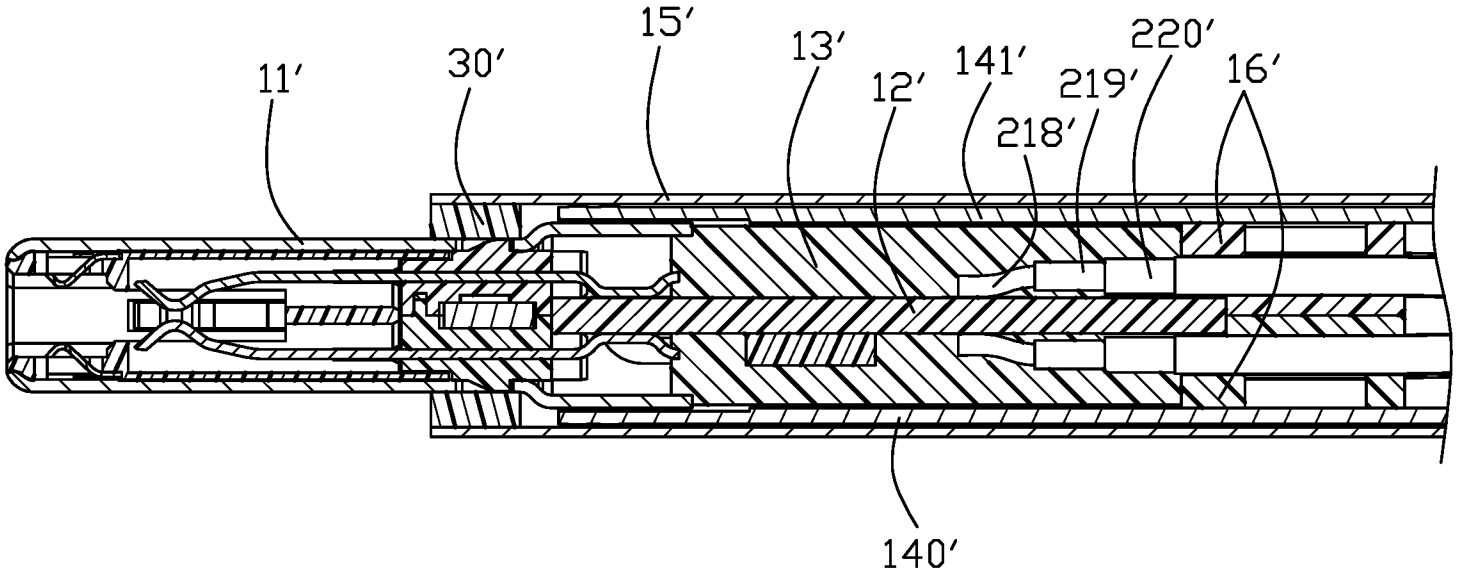
FIG. 17 is another cross-section view of the cable of the cable connector assembly taken along line 17-17 in FIG. 10.

Referring to FIGS. 9 to 17, a cable connector assembly, in accordance with a second embodiment of present invention, for mating with a mating connector (not shown), comprises an electrical connector 1' and a cable 2' electrically connected with the electrical connector 1'. The electrical connector 1' includes s mating member 11', in which the mating port is formed with two rows of terminals arranged by two sides, for mating with the mating connector, a printed circuit board (PCB) 12' connected between the mating member 11' and the cable 2', an inner mold 13' enclosing the conjunction portion of the cable 2' and the PCB 12', a shielding case 14' enclosing the mating member 11' and the PCB 12', an insulative outer case 15' enclosing the shielding case 14' and the cable 2', and a management block 16' for locating the cable 2'.

Referring to FIGS. 12 to 15, The cable 2' includes a plurality of core wires 21', an inner insulative layer 22' enclosing the corresponding core wires 21', a first braided layer 23' enclosing the inner insulative layer 22' and a outer insulative layer 24' formed on outside of the first braided layer 23'. The cable 2' is used to transmit USB Type C signal. The core wires 21' includes four (differential) pairs of high-speed signal lines 212' for transmitting high-speed signals, a pair of spare signal lines 213', a detection signal line 214' for transmitting detection signals, a power supply line 215' for supplying power to the connector, a pair of low-speed signal lines 216' and a pair of power signal lines 217' that transmit power signals. The low-speed signal lines 216' are used to transmit USB 2.0 signals with lower speed. The pair of power signal lines 217' is used respectively to transmit positive and negative signals of the power source. The pair of spare signal lines 213' can set transmission of signals such as audio as required.

All the core wires 21' except the pair of power signal wires 217' are coaxial wires. The coaxial lines include a center conductor 218', an insulating layer 219' covering the center conductor 218' and a second braided layer 220' wrapped around the insulating layer 219'. The first and second braided layers 23', 220' can effectively weaken the external radiation of the center conductor 218' and strengthen its own anti-interference ability.

The core wires 21' are arranged up and down in two rows. An upper row includes two pairs of high-speed signal lines 212', the pair of low-speed signal lines 216', a spare signal line 213' and a power signal line 217'. The lower row includes two pairs of high-speed signal lines 212', a detection signal line 214', a power supply line 215', a spare signal line 213' and a power signal line 217'. The cable 2' is flat and is divided into a first side 201' and a second side 202' in a width direction. The two pairs of high-speed signal lines 212' are located on the first side 201' and are oppositely disposed one above the other. The power signal lines 217' are located on the second side 202' and are oppositely disposed one above the other. The other two pairs of high-speed signal lines 212' are located inside the power signal lines 217' in the width direction. The pair of low-speed signal lines 216' and a spare signal line 213' are disposed between the two pairs of high-speed signal lines 212' in the upper row, and the spare signal lines 213' are located between the low-speed signal lines 216' and the high-speed signal lines 212' located on the first side 201'. The detection signal line 214' in the lower row is adjacent to the high speed signal lines 212' on the first side 201'. The lower spare signal line 213' in the low row is adjacent to the high speed signal lines 212' near the second side 202'. The power supply line 215' for powering the connector 1' internally is located between the detection signal line 214' and the spare signal line 213' in the lower row. This arrangement allows the spare signal lines 213 to be arranged separately, effectively preventing them from coupling with each other.

The cable 2' is not provided with a ground wire, instead, the second braided layer 220' of each coaxial line serves as a ground wire, and can satisfy a voltage drop of 250 mV when there is a current of 3 A or 5 A. The specifications of the two power signal lines 217' can be flexibly designed with 26 or 24 AWG (American wire gauge), and can meet 500 mV voltage drop when there is 3 A or 5 A current.

The PCB 12' includes an upper surface and a lower surface, and the front and back conductive sheets are symmetrical, because it can be inserted along both of the forward and backward direction. The PCB 12' defines a plurality of first conductive pads 120' on a front end thereof, a grounding region 121' on a rear end and a plurality of second conductive pads 122' between the first conductive pads 120' and the grounding region 121'. Both of the upper surface and the lower surface define the first conductive pads 120', the grounding region 121' and the second conductive pads 122'. The first conductive pads 120' are electrically connected to the contacts of the mating member 11'. The grounding regions 121' are soldered to the second braided layers 220'. Each of the center conductors 218' is electrically connected to the second conductive pads 122' corresponding on the front and rear ends of the PCB 12' respectively.

The shielding case 14' includes a first case 140' and a second case 141'. The first case 140' includes a first edge 1400', an upper surface 1401', and a tail portion 1402' extending from the upper surface 1401' toward the extending direction of the cable 2'. The second case 141' includes a second edge 1410', a lower surface 1411' and a retaining portion 1412' extending from the lower surface 1411' towards the extending direction of the cable 2'. The end of the first braided layer 23' of the cable 2' is overturned on the surface of the cable 2', and is wrapped with a copper foil 25'. The tail portion 1402' extends to the copper foil 25'. The retaining portion 1412' is held on the tail portion 1402' and the copper foil 25' to be caulked on the cable 2'. The first case 140' and the second case 141' are assembled together by laser welding. The shielding case 14' and the mating member 11' are also assembled by laser welding. In this embodiment, an insulative or rubbery front cap 30' surrounds the mating member 11' and is enclosed in the shielding case 14' for better sealing performance, and a pair of insulative or rubbery rear caps 32' sandwiched between the copper foil 25' and the outer case 15' for compensating the contour difference between the outer profile of the cable 2' with the associated copper foil 25' thereon and that of the outer case 15' which is essentially of a capsular cross-sectional configuration.

Notably, the cable 2' is essentially of a rectangular cross-sectional with corresponding curves at four corners while the outer case 15' is essentially of a capsular cross-sectional configuration for compliance with the similar capsular cross-sectional configuration of the mating member 11'. In this embodiment, the outer case 15' is slightly larger than the mating member 11' while in the first embodiment a front portion of the metal shell 6 directly covers the housing 11 to be a part of the mating member defined in the second embodiment. In other words, in the second embodiment, the pair of rear caps 32' are sandwiched between the two lateral sides of the retaining portion 1412' and the outer case 15' in the transverse direction. Similarly and analogously, in the first embodiment, the pair of plastic members 7, which are analogous to the pair of rear caps 32', are sandwiched between the crimping member 3, which is analogous to the retaining portion 1412', and the metal shell 6, which is analogous to the outer case 15', in the transverse direction.

Notably, both the rear cap 32 and the plastic member 7 are essentially of a crescent configuration wherein an inner side of the plastic member 7 extends more curvedly than the rear cap 32. It is also noted that in the first embodiment, in a cross-sectional view the cable 2 is smaller than the mating member in both the vertical direct and the transverse direction while in the second embodiment, in a cross-sectional view the cable 2' is smaller than the mating member 11' in the transverse direction while is not smaller or even bigger in the vertical direction.

What is claimed is:

1. A cable connector assembly comprising:

a cable connector;

a cable electrically connected with the cable connector;

an outer shell enclosing at least a portion of the cable connector and enclosing a portion of the cable, the outer shell having an inner dimension greater than an outer dimension of the cable;

a crimping ring secured to the cable; and a pair of filling members disposed at two opposite sides of the crimping ring between the outer shell and the crimping ring; wherein the cable connector comprises an insulative housing, the outer shell fully enclosing the insulative housing in a lengthwise direction of the insulative housing, a front portion of the outer shell being used to be inserted into a mating connector;

the outer shell has a constant cross section and is sleeved on the insulative housing along a front to rear direction; and each of the filling members having an inner surface conforming to an outer surface of the crimping ring and an outer surface conforming to an inner surface of the outer shell.

2. The cable connector assembly as claimed in claim 1, wherein the cable is directly soldered with the cable connector.

3. The cable connector assembly as claimed in claim 1, wherein the cable connector comprises a mating member extending beyond a front end of the outer shell for being inserted into a mating connector.

4. The cable connector assembly as claimed in claim 3, further comprising an inner printed circuit board connected between the mating member and the cable.

5. A cable connector assembly comprising:

a connector including an insulative housing forming thereof a mating member with a mating port exposed to an exterior in a front-to-back direction;

a plurality of conductive terminals disposed in the housing and exposed in the mating member;

a cable including a plurality of wires arranged with one another along a transverse direction perpendicular to the front-to-back direction, and connected to a rear side of the connector in the front-to-back direction;

a metallic retaining portion tightly grasps the cable;

a tubular outer case extending along the front-to-back direction and enclosing at least a rear portion of the housing and a front portion of the cable; and a pair of filling members positioned between the outer case and the cable in the transverse direction.

6. The cable connector assembly as claimed in claim 5, wherein in a cross-sectional view, a dimension of the cable in said transverse direction is smaller than that of the mating member.

7. The cable connector assembly as claimed in claim 6, wherein the cable defines a thickness in a vertical direction perpendicular to both the front-to-back direction and the transverse direction, and the terminals are arranged in two rows by two sides of the mating port, each row extending along the transverse direction.

8. The cable connector assembly as claimed in claim 7, wherein the outer case keeps a constant dimension along the front-to-back direction.

9. The cable connector assembly as claimed in claim 8, wherein the metallic retaining portion encircles the cable.

10. The cable connector assembly as claimed in claim 9, wherein said retaining portion is a unitary part of a metallic inner shielding case which encloses a rear side of the mating member while being enclosed within the outer case, and said outer case is insulative.

11. The cable connector assembly as claimed in claim 9, wherein said retaining portion is a crimping member and connected to at least a grounding wire of the cable or a grounding contact of said terminals, and the outer case is metallic and enclosing the mating member.

12. The cable connector assembly as claimed in claim 5, wherein the metallic retaining portion is sandwiched between the cable and the filling members in the transverse direction.

13. The cable connector assembly as claimed in claim 7, wherein the cable includes only one row of wires and in the cross-sectional view a dimension of the cable in the vertical direction is smaller than that of the mating member.

14. The cable connector assembly as claimed in claim 13, wherein the wires of the cable are directly connected to the terminals.

15. A cable connector assembly comprising:

a cable connector having a mating member;

a cable electrically connected with the cable connector;

an outer shell enclosing at least a portion of the cable connector and enclosing a portion of the cable, the outer shell having an inner dimension greater than an outer dimension of the cable;

a shielding case having an end mounted on the mating member and an opposite end mounted on the cable; and a pair of filling members disposed at two opposite sides of the shielding case between the outer shell and the shielding case; wherein the mating member extending beyond a front end of the outer shell for being inserted into a mating connector;

the outer shell has a constant cross section and is sleeved on the mating member along a front to rear direction; and each of the filling members having an inner surface conforming to an outer surface of the other end of the shielding case and an outer surface conforming to an inner surface of the outer shell.

16. The cable connector assembly as claimed in claim 15, further comprising an inner printed circuit board connected between the mating member and the cable.

17. A cable connector assembly comprising:

a connector including an insulative housing forming thereof a mating member with a mating port exposed to an exterior in a front-to-back direction;

a plurality of conductive terminals disposed in the housing and exposed in the mating member;

a cable including a plurality of wires arranged with one another along a transverse direction perpendicular to the front-to-back direction, and connected to a rear side of the connector in the front-to-back direction; and a tubular outer case extending along the front-to-back direction and enclosing at least a rear portion of the housing and a front portion of the cable; wherein in a cross-sectional view, a dimension of the cable in sad transverse direction is smaller than that of mating member so as to have a pair of filling members sandwiched between the outer case and the cable in the transverse direction for compensation consideration; wherein said pair of filling members are spaced from each other with the cable therebetween in the transverse direction.

18. The cable connector assembly as claimed in claim 17, wherein each of said filling members is in form of crescent to comply with the cable and the outer case.

19. The cable connector assembly as claimed in claim 17, further including metallic retaining portion tightly grasping the cable and sandwiched between the cable and the pair of filling members in the transverse direction.

20. The cable connector assembly as claimed in claim 17, wherein said outer case keeps a constant dimension along the front-to-back direction.

* * * * *